United States Patent [19]

Maublanc

[11] 4,387,482

[45] Jun. 14, 1983

[54] MODULAR SINGLE OR DOUBLE ACTION DOOR CLOSURE SYSTEM

[75] Inventor: Georges Maublanc, St. Germain du Plain, France

[73] Assignee: Pont-A-Mousson S.A., Nancy, France

[21] Appl. No.: 205,494

[22] Filed: Nov. 10, 1980

[30] Foreign Application Priority Data

Nov. 15, 1979 [FR] France ..... 79 28191

[51] Int. Cl.[3] ..... E05F 3/00

[52] U.S. Cl. ..... 16/64; 16/62

[58] Field of Search ..... 16/62, 64, 69, 79; 102/377, 438

[56] References Cited

U.S. PATENT DOCUMENTS

| | | | |
|---|---|---|---|
| 2,471,707 | 5/1949 | Van Veen et al. | 16/62 |
| 3,000,597 | 9/1967 | Bell et al. | 102/377 X |
| 3,255,482 | 6/1960 | Flint | 16/62 |
| 3,345,946 | 10/1967 | Johnson et al. | 102/377 |

*Primary Examiner*—Paul A. Bell

*Attorney, Agent, or Firm*—Sughrue, Mion, Zinn, Macpeak & Seas

[57] ABSTRACT

A modular door closure system comprises a rack and pinion motor assembly with single action opening 2*a* mounted in a first case 5*a;* a similar motor assembly with double action opening mounted in a housing element 5, 6; and a spring and shock absorber restoration drive 4 mounted in a second case 7 that can be assembled with either the first case 5*a* to constitute a single action door closure 1*a,* or with the housing element to constitute a double action door closure 1.

8 Claims, 6 Drawing Figures

1
2
3
4
5
5c
6
6c
6d
7
7a
7b
7d
8
9
10
12
13
14
15
16
17
18
19
20
21
22
23
24
25
26
27
28
29
30
31
32
X
Q
g 1
2
3
4
5
5c
6
6c
7
7a
7d
9
10
11
12
14
20
21
25
27
28
29
31
33
34
e
P

MODULAR SINGLE OR DOUBLE ACTION DOOR CLOSURE SYSTEM

The present invention relates to a modular door closure assembly.

Door closures are either single action for a one-way door, or double action for a two-way door.

Single action door closures are often formed of a rotatable pinion fixed to the door to be closed, which pinion engages with a toothed rack connected to a spring apparatus and a shock absorber, the assembly being placed in a housing of appropriate form.

The double action door closure generally consists of a rotatable pinion fixed to the door to be closed and has one or more cams assuring the displacement of an operating lever of a spring apparatus and a shock absorber, the assembly being also placed in a housing of corresponding form.

The principal disadvantage of the known prior art is that it is impossible to use the same elements to create a single action door closure and a double action door closure. In particular, the two types of door closures indicated above need housings with very different proportions, and the movable pieces are not transposable one with the other. This means on the one hand, increased production costs due to the fact that the pieces cannot be produced in very large quantities, and on the other hand, a large number of different pieces must be produced and stocked.

The object of the invention is to remedy this disadvantage and as such, presents a modular system for a door closure characterized by a motor assembly with a single action opening contained in a first case; a motor assembly with a double action opening contained in a housing element; and a spring drive assembly and shock absorber contained in a second case that can be assembled with either the first case to constitute a single action door closure, or with the housing element to constitute a double action door closure.

The invention also has as an object a single action door closure comprised of a motor assembly with a single action opening and the drive assembly of this modular system, as well as a double action door closure comprising a motor assembly with a double action opening and the drive assembly of the same modular system.

Other characteristics and advantages of the invention will become obvious in the following description, given as a non-limiting example and in regard to the attached drawings, in which.

Figure 3:
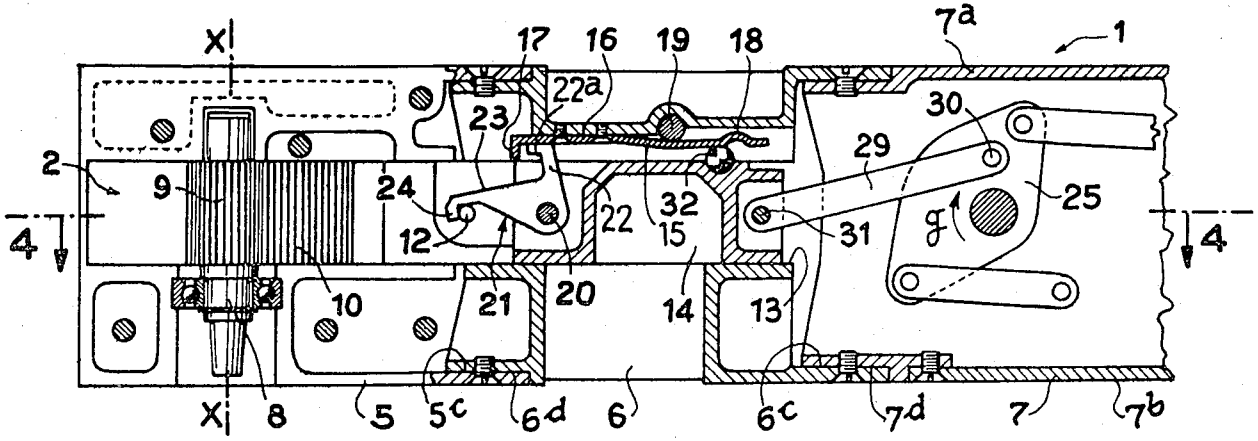
FIG. 3 is a large scale view of one part of FIG. 1, the door closure in an "open door" position.
Figure 4:
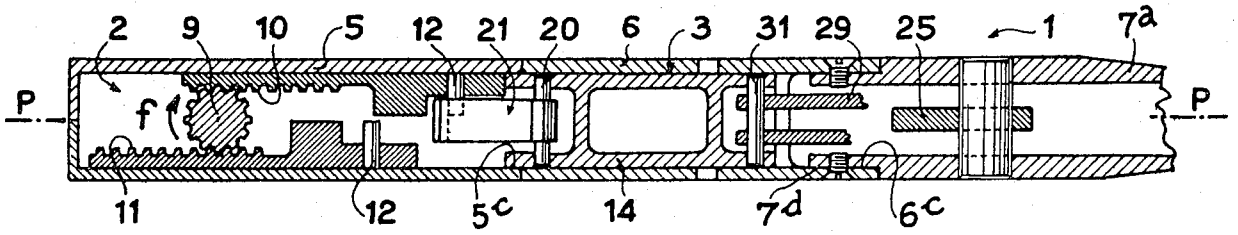
Figure 5:
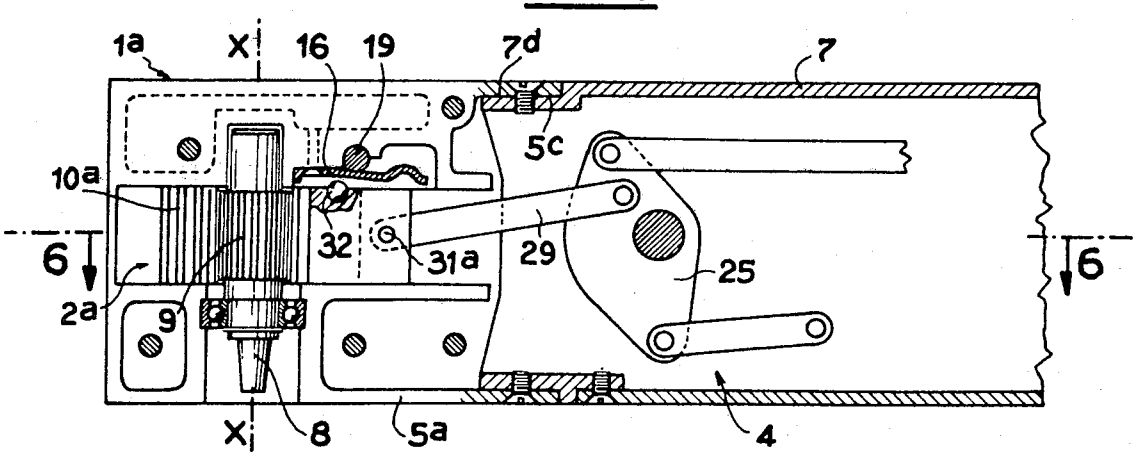
Figure 6:
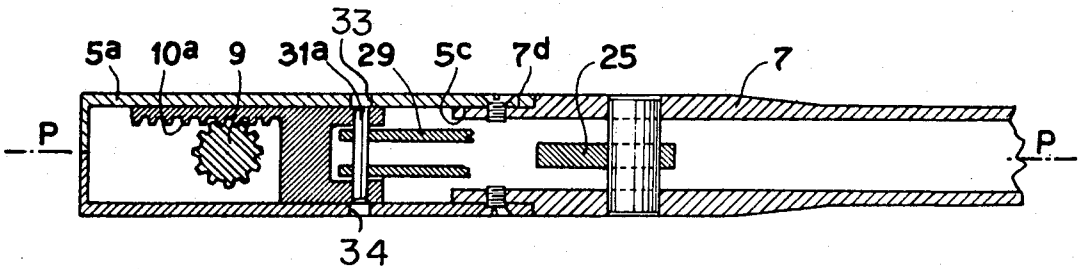

FIG. 4 is a cross-sectional view taken along line 4—4 of FIG. 3; and FIGS. 5 and 6 are analogous views of FIGS. 3 and 4 respectively but corresponding to the single action door closure according to the invention.

Figure 1:
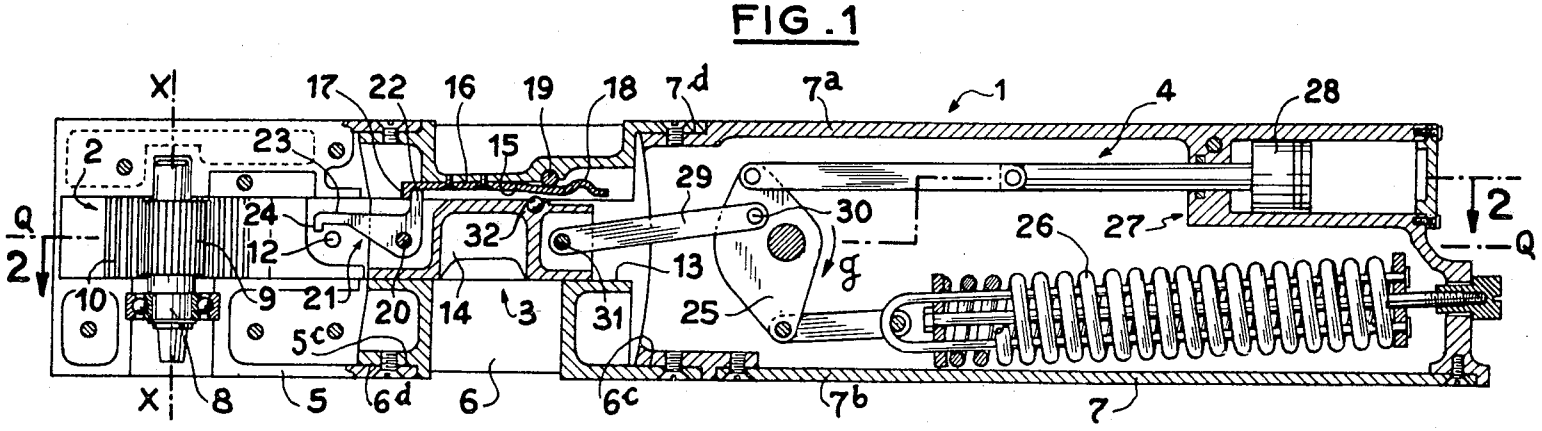
FIG. 1 is a vertical cross section view of a double action door closure, according to the invention, in a rest position.
Figure 2:
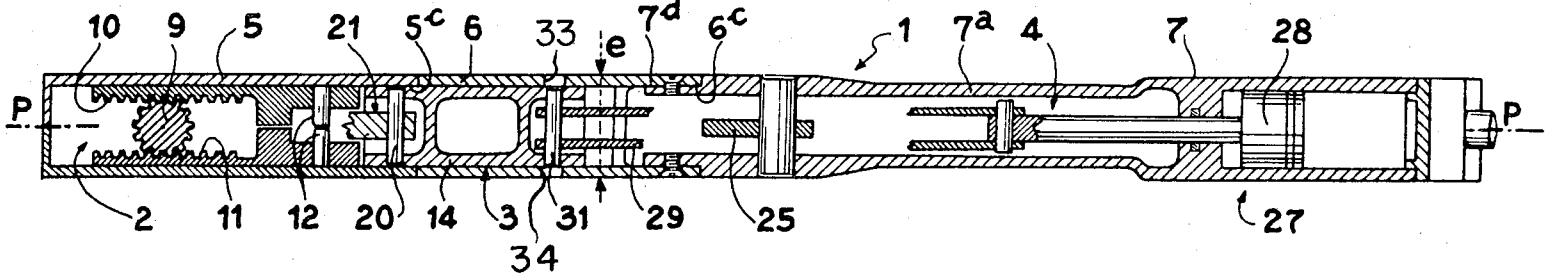
FIG. 2 is a cross sectional view taken along line 2—2 of FIG. 1.

Door closure 1, represented in FIGS. 1 to 4, consists of three parts, from left to right in FIG. 1: a rack and pinion assembly 2, a connecting assembly 3 and a restoration drive assembly 4. Each assembly 2 to 4 is lodged in a case 5 to 7 respectively; these cases are fitted one in the other to constitute, after being screwed together, the housing of the door closure. The housing has a generally parallelepipedic form whose thickness e (FIG. 2) is constant and small enough to mount the door closure in the door itself. More precisely, the case 5 is constituted of two halves or subcasings screwed one to the other following a plane of the vertical median joint P, the case 6 is a monoblock, and the case 7 is constituted of a body 7*a* open on the large vertical face and a flat lid 7*b* screwed on this face. Each of the cases 5 and 6 presents at its right end a female form 5*c*, 6*c*, respectively, and each of the cases 6 and 7 presents at its left end a male form 6*d*, 7*d*, respectively able to be fitted without play in the forms 5*c*, 6*c*, respectively. In this example, the forms 5*c* and 6*c* on the one hand, and 6*d* and 7*d* on the other hand, are identical.

The assembly 2 comprises a spindle 8 whose vertical axis X—X is freely rotatable in the case 5 but axially fixed. The intermediary part of this spindle forms a pinion 9 that engages with two rectilinear racks 10 and 11 that each slide against a lateral wall of the case 5 and which form mirror images one of the other. At a small distance from its right extremity, each rack has a horizontal pin 12 directed towards the other rack. At rest, (FIG. 2), the pins 12 are in extension with one another, and the extremities of the racks are contained in two vertical planes perpendicular to the vertical symmetry plane P of the door closure.

The case 6 of the assembly 3 has a central passage 13 with a rectangular section in which slides a parallelepipedic piston 14. The upper wall of passage 13 accommodates a longitudinal groove 15 in which is fixed a flexible plate 16. The left extremity of the latter is folded toward the bottom to define a short latch 17, and its right extremity, that possesses a vertical means, presents one rounded groove 18. The plate 16 is fixed by screws in its left part, and a rotatable cam 19 with a horizontal axis permits regulation of the height of a part of this plate situated between the screws and the groove 18.

The left extremity of piston 14 carries a transverse axle 20 on which is mounted an L-shaped lever 21 with two arms. In the rest position (FIG. 1), an arm 22 is retained by the latch 17 in vertical position; the other arm 23 projects horizontally towards the left from piston 14, and a hook 24 directed downwardly and forming the extremity of this arm, is situated over the common horizontal plane of the pins 12.

The restoration drive assembly 4 includes a rotatable lever 25 with a horizontal axis, one arm of the lever being linked to an adjustable pressure spring 26 and the other to a hydraulic shock absorber 27, also adjustable, having a piston 28. This assembly 4 is well known in the prior art; it will not be described in more detail and is represented schematically. Two parallel connecting rods 29 are articulated at one extremity to an off-center horizontal axis 30 on the lever 25 and at the other extremity to a horizontal axle 31 mounted in the right extremity of piston 14. The axles 20 and 31 and the pins 12 are parallel and contained in the median horizontal plane Q of the door closure.

The function of the double action door closure is the following.

The gear case of the door closure is, for example, fixed in the upper framework of a door, the lower extremity of spindle 8 being fixed to the door, following its axis of rotation. All other appropriate dispositions of the door closure can also be envisaged.

Under the effect of the opening of the door in a first direction, the pinion 9 turns in a clockwise direction as shown by arrow f (FIG. 4), drawing with it the rack 10 which slides to the right, and rack 11 which slides in the inverse direction. Under the effect of this sliding, the rack 10 pushes directly on the piston 14, which also slides toward the right. The connecting rods 29 make the lever 25 turn in the direction of the arrow g (FIG. 3), which causes on one hand the compression of spring 26 and on the other hand the displacement toward the right without substantial hindrance of the shock absorbing piston 28 in its cylinder. This opening movement is limited by the abutment of the rack 11 against the extreme left wall of the case 5.

When the rack 10 comes in contact with the piston 14, its pin 12 is exactly behind the hook 24 of lever 21, under arm 23. From the beginning of the sliding of piston 14, the arm 22 of lever 21 moves away from the abutment 17, thereby letting lever 21 rotate counterclockwise under the effect of gravity and lowering arm 23 onto the pin 12 of rack 10. During the following sliding, the upper bent extremity 22*a* of arm 22 slides the length of the plate 16 and assures that the hook 24 cannot rise again and that it remains in engagement with pin 12.

When the door is released, the spring 26 expands to make lever 25 rotate in the inverse direction of the arrow g, and this rotation is braked by the shock absorber 27, the speed of return being regulatable. The rotation of lever 25 in the inverse direction of the arrow g provokes a thrust of piston 14 towards the left by the connecting rods 29; the piston 14, in turn, pushes the rack 10 towards the left which makes the pinion g turn in the inverse direction of arrow f, assuring the closing of the door. When the door is closed, the arm 22 of lever 21 meets the abutment 17 which raises it and returns the lever 21 to its original position in FIG. 1. During this movement, the hook 24 is designed from pin 12. The bent extremity 22*a* of arm 22 crosses through an opening of the abutment 17 to permit the swinging of lever 21.

The opening of the door in the other direction entails the same functioning of the door closure, but under the effect of the rack 11 whose pin 12 engages the hook 24. If the door is to be closed at a speed faster than the preset closing speed assured by the drive assembly 4, the pinion 9 becomes the closing motor in such a way that the rack tends to move away from piston 14. Meanwhile, the engagement of the pin 12 behind hook 24 opposes this separation in such a way that the piston 14 is drawn by the rack and draws with it the connecting rods 29, the lever 25 and the shock absorbing piston 28 which brakes the movement. The shock absorber 27 can comprise, as known, an apparatus for limiting the oil pressure that permits, in such a case, an increase in the displacement speed of piston 28.

Of course, the shock absorber 27 can also be provided with means permitting the abrupt acceleration of the movement at the end of the closing movement in order to guarantee the complete closure of the door and in particular the engagement of the door's lock.

As is seen, in the course of functioning, the piston 14 is always interdependent with the rack which moves towards the right, because of the hook 24, regardless of the direction of rotation of pinion 9 and hence regardless of the direction of the opening of the door.

The plate 16 can serve not only as the abutment for the lever 21 but also as the apparatus for maintaining the door in open position, or "door stop". In effect, while the cam 19 is retracted, the plate 16 does not interfere with the trajectory of a ball 32 supported by the piston 14. Nevertheless, if it is desired, cam 19 can be given an angular position in which it forces downward the right part of plate 16. In this case, the groove 18 latches elastically at the end of the course of the opening, on the ball 32, thereby constituting the door stop.

FIGS. 5 and 6 show a single action door closure 1*a* formed of a rack and pinion assembly 2*a* and a drive assembly 4.

The assembly 2*a* is almost identical to the assembly 2 of FIGS. 1 to 4; nevertheless it comprises a single rack 10*a* analogous to the rack 10 but provided at its right extremity with a guide block sliding on the two lateral walls of the case 5*a* and carrying a transverse axle 31*a*. The connecting rods 29 of the assembly 4 are directly articulated on this axle 31*a*. Also, the stopping apparatus of the door 16–19 is mounted in the case 5*a* and the ball 32 in the groove of the rack 10*a*.

The exterior dimensions of the case 5*a* are the same as those of the case 5, in particular the female form 5*c* is seen again fitting together with the male form 7*d* of case 7.

For the single action door closure, it is no longer necessary to use an intermediate connecting assembly. The functioning of such a single action door closure is substantially identical but simplified with regard to the double action door closure, since the single rack 10*a* is always linked via the lever 25 of the driving assembly 4 to the spring and shock absorber.

The mutual interlocking of assemblies 2 to 4 or 2*a* and 4*a* is simple, and a rigid connection is effected by complementary screwing. The orifices 33, 34 are provided respectively in the case 6 of the intermediary connection assembly 3 (FIG. 2) and in the case 5*a* of the rack and pinion assembly 2*a* (FIG. 6) to permit the insertion of the pins 31 31*a* and, respectively, in the left extremity of the connecting rods 29.

Modular production of this single and double action door closure permits a lowering of production costs, as most of the pieces are identical in the two cases and can thus be fabricated in a large series. This modularity also permits reducing the number of pieces in stock which are necessary to achieve the assembling of these door closures, and also reducing the number of replacement pieces furnished to repairmen.

What is claimed is:

1. A modular door closure system comprising: a first motor assembly having a single action door-opening mechanism, a second motor assembly having a double action door-opening mechanism; a spring- and shock absorber-restoration drive assembly matable with both said first and second motor assemblies to form single action and double action door closures, respectively; a first elongated casing containing said first motor assembly and having a first coupling means; a second elongated casing containing said second motor assembly and having a second coupling means identical to said first coupling means; and a third elongated housing having a third coupling means matable with said first and second coupling means to form unitary single action and double action door closures, respectively; wherein the transverse dimensions of said first, second and third elongated casings are substantially the same.

2. A modular door closure system comprising: a first motor assembly having a single action door-opening mechanism, a second motor assembly having a double action door-opening mechanism; a spring- and shock absorber-restoration drive assembly matable with both said first and second motor assemblies to form single action and double action door closures, respectively; a first elongated casing containing said first motor assembly and having a first coupling means; a second elongated casing containing said second motor assembly and having a second coupling means identical to said first coupling means; and a third elongated housing having a third coupling means matable with said first and second coupling means to form unitary single action and double action door closures, respectively; said single action door closure comprising: the first motor assembly with a single action opening (2*a*) and the drive assembly (4) of the modular system, the first (5*a*) and third (7) casings being assembled together.

3. A modular door closure system comprising: a first motor assembly having a single action door-opening mechanism, a second motor assembly having a double action door-opening mechanism; a spring- and shock absorber-restoration drive assembly matable with both said first and second motor assemblies to form single action and double action door closures, respectively; a first elongated casing containing said first motor assembly and having a first coupling means; a second elongated casing containing said second motor assembly and having a second coupling means identical to said first coupling means; and a third elongated housing having a third coupling means matable with said first and second coupling means to form unitary single action and double action door closures, respectively; said double action door closure comprising: the second motor assembly with a double action opening (2–3) and the drive assembly (4) of the modular system the second casing (5–6) and the third casing (7) being assembled together.

4. A modular door closure system comprising: a first motor assembly having a single action door-opening mechanism, a second motor assembly having a double action door-opening mechanism; a spring- and shock absorber-restoration drive assembly matable with both said first and second motor assemblies to form single action and double action door closures, respectively; a first elongated casing containing said first motor assembly and having a first coupling means; a second elongated casing containing said second motor assembly and having a second coupling means identical to said first coupling means; and a third elongated housing having a third coupling means matable with said first and second coupling means to form unitary single action and double action door closures, respectively; wherein said restoration drive assembly comprises connecting rod means projecting longitudinally outwardly from said coupling means of said third housing, said connecting rod means having a connecting pin-receiving bore in the projecting end thereof; wherein said first and second motor assemblies having connecting pin-receiving bores therein; and wherein said first and second casings have openings therein, alignable with the bores in said connecting rod means, for permitting a connecting pin to be inserted therethrough and into the bores of said connecting rod means and of said first and second motor assemblies, respectively, thereby mechanically interconnecting said drive assembly and one of said motor assemblies.

5. A modular system according to claim 4 further comprising a connecting pin, insertable through said openings, for selectively interconnecting said connecting rod means and one of said first and second motor assemblies.

6. A modular system according to claim 5 wherein said first motor assembly comprises a rack and pinion assembly having only a single rack and a pinion which is adapted to be driven by the opening movement of a single action door, the pinion being permanently meshed with the rack, the bore of said first motor assembly being located in said single rack.

7. A modular system according to claims 5 or 6 wherein said second casing comprises first and second-subcasings detachably secured to each other, and further comprising a rack and pinion assembly disposed in said first subcasing and comprising a pinion permanently meshed with a pair of oppositely facing parallel racks, and a selective connecting assembly in said second subcasing for selectively engaging a different one of said parallel racks with said connecting rod means for opposite opening directions, respectively, of a door, said opening of said second casing being located in said second subcasing.

8. A modular system according to claims 4, 5 or 6 wherein the transverse dimensions of said first, second and third elongated casings are substantially the same.

* * * * *